US012721378B2

(12) United States Patent
Bruna

(10) Patent No.: US 12,721,378 B2
(45) Date of Patent: Sep. 1, 2026

(54) SMOKING DEVICE OPERATABLE BY VIBRATION GENERATED THROUGH TACTILE MOVEMENT

(71) Applicant: JT International SA, Geneva (CH)

(72) Inventor: Matteo Bruna, Geneva (CH)

(73) Assignee: JT International SA, Geneva (CH)

( * ) Notice: Subject to any disclaimer, the term of this patent is extended or adjusted under 35 U.S.C. 154(b) by 381 days.

(21) Appl. No.: 18/697,651

(22) PCT Filed: Oct. 12, 2022

(86) PCT No.: PCT/EP2022/078412
§ 371 (c)(1),
(2) Date: Apr. 1, 2024

(87) PCT Pub. No.: WO2023/066759
PCT Pub. Date: Apr. 27, 2023

(65) Prior Publication Data

US 2025/0000174 A1 Jan. 2, 2025

(30) Foreign Application Priority Data

Oct. 18, 2021 (EP) ..... 21203263

(51) Int. Cl.
*A24F 40/60* (2020.01)
*A24F 40/51* (2020.01)

(52) U.S. Cl.
CPC ..... *A24F 40/60* (2020.01); *A24F 40/51* (2020.01)

(58) Field of Classification Search
None
See application file for complete search history.

(56) References Cited

U.S. PATENT DOCUMENTS

2011/0083517 A1* 4/2011 Muroyama ..... B25J 13/084 73/862.046
2019/0150512 A1* 5/2019 Furudono ..... A61M 15/06

FOREIGN PATENT DOCUMENTS

CN 103948177 A 7/2014
CN 113349460 A 9/2021
EP 3838006 A1 6/2021
WO WO-2016009202 A1 * 1/2016 ..... A61M 15/06

OTHER PUBLICATIONS

International Search Report for PCT/EP2022/078412 mailed Feb. 23, 2023. 4 pages.

* cited by examiner

*Primary Examiner* — Michael H. Wilson
*Assistant Examiner* — Tobey C Le
(74) *Attorney, Agent, or Firm* — Lerner David LLP

(57) ABSTRACT

A smoking device operatable by vibration generated through tactile movement includes a casing, wherein at least one side of the casing is provided with an undulating surface profile, whereby vibration signals are produced by tactile movement over the undulating surface profile, and an electronic system configured to activate or deactivate the device based on the vibration signals.

16 Claims, 4 Drawing Sheets

SMOKING DEVICE OPERATABLE BY VIBRATION GENERATED THROUGH TACTILE MOVEMENT

CROSS-REFERENCE TO RELATED APPLICATIONS

The present application is a national phase entry under 35 U.S.C. § 371 of International Application No. PCT/EP2022/078412, filed Oct. 12, 2022, published in English, which claims priority to European Application No. 21203263.5 filed Oct. 18, 2021, the disclosures of which are incorporated herein by reference.

TECHNICAL FIELD

The present invention relates to the field of tobacco, more specifically to the electronic cigarette which may produce aerosol and/or vapour, wherein the device is operatable through vibrations from tactile movements and/or audio-based feedbacks.

BACKGROUND OF THE INVENTION

Smoking devices which heat rather than burn vaporisable material which may or may not contain tobacco-containing substrate to create a vapour for inhalation are becoming popular. They generally comprise a heat source powered by gas or electricity and a chamber for receiving a plug of vaporisable material or a disposable capsule containing a vapour-generating product. When in use, the plug or capsule is inserted into the device and heated by the heat source to generate a vapour for inhalation.

Such new type of smoking devices, in some instances, are being used indoors as the vapours generated by the devices are consisting of predominantly water vapours, as they do not burn or thermally decompose the flavour generating source.

A number of vaping devices with liquid capsules used for vaping for different purposes are known. For example, US20190150512 relates to a heating-type flavour inhaler, wherein on its circumferential wall casing, a plurality of protrusions constituting of a bumpy pattern that is made of metal and facilitates heat dissipation is provided on an outer circumferential surface of at least a position where a heater is arranged. The protrusions are provided to allow the heated vapour to escape more easily from the casing.

Another patent document CN103948177 relates to an electronic smoking device comprising a housing and a fingerprint collection surface located on the housing. The user, through his finger, contacts the fingerprint collection surface, wherein the fingerprint surface is uneven. The fingerprint identification is used to activate the atomization device and an LED indicator light provides the status of the fingerprint identification device.

Such smoking devices can be used not only outdoor but often it can be used subtly indoor. Often, certain users prefer to use the smoking device in a more subtle and unnoticeable manner such as checking the battery status, activating- or deactivating the device, or controlling its heating temperature.

Currently, the devices available on the market do not focus on this specialized but increasing needs.

It is therefore an object of the present invention to provide an improved smoking device and an improved method to use such smoking device.

SUMMARY OF THE INVENTION

The present inventors have found solutions to the above-posed problems through the present invention as illustrated in the present specification.

In a first aspect, present invention relates to a smoking device operatable by vibration generated through tactile movements, comprising a casing, wherein at least one side of the casing is provided with an undulating surface profile e.g., having peaks and grooves, whereby vibration signals and/or audio signal are produced by tactile movement over said undulating surface profile; an electronic system configured to activate or deactivate the smoking device based on the vibration signals.

In a second aspect, the invention relates to a method of operating a smoking device according to claim 1, comprising the step of (a) generating a vibration through a tactile movement on the undulating surface of the casing of the smoking device; (b) converting vibration signals to electrical signals through a signal conditioning or processing device; (c) activating or deactivating an output device and/or a function of the smoking device.

The smoking device according to the present invention allows the user to control the device not only in an easier and more subtle (unnoticeable) manner, it also increases the entertaining factors as certain users may find it to be pleasant to control the device through vibrations e.g., mechanical vibrations generated by tactile movements as well as sounds which exist as waves of vibrations. Moreover, such mode of operation of the device is intuitive and straight-forward.

According to some embodiments, the electronic system comprises one or more input/output devices, and a signal conditioning or processing device for converting vibration signals generated from the tactile movement over the undulating surface profile of the smoking device, into electrical signals which are fed to the electronic system to activate or deactivate corresponding output device based on the vibration signals.

According to some embodiments, the signal conditioning or processing device is a transducer. The transducer may comprise of a magnet and coil and be provided in form such as a piezoelectric crystal to detect mechanical vibrations (or rattling), or be provided in form of a microphone to detect sound waves or be provided in other forms.

According to other embodiments, the input device comprises one or more sensors, wherein the sensor comprises a piezoelectric sensor, an accelerator, MEMS, or a microphone. These components are able to convert the input signals (such as mechanical vibrations or sounds) into electrical signals.

In some preferred embodiments, the vibration signals are generated from mechanical vibration or sound waves.

According to other embodiments, the input device comprises a transducer.

In yet some embodiments, the undulating surface profile comprises peaks and grooves, forming at least two, three, four or five, six or more different undulating surface profiles to generate different vibration signals.

In some preferred embodiments, the output device comprises one or more LED lights, piezo electric igniter, on/off button, temperature control, loud speakers and/or power status.

In some preferred embodiments, the height difference between the peaks and the grooves of the undulating surface profile is between 0.5 mm and 10 mm, or preferably between 1 mm and 7 mm, or preferably between 2 mm and 5 mm, or more preferably about 4 mm.

In some preferred embodiments, the distance between one peak to another peak of the undulating surface profile is between 0.5 mm and 8 mm, or preferably between 1 mm and 6 mm, or preferably between 1.5 mm and 5 mm, or more preferably about 3 mm.

In some preferred embodiments, the distance between one groove to another groove of the undulating surface profile is between 0.5 mm and 6 mm, or preferably between 1 mm and 5 mm, or preferably between 2 mm and 4 mm, or more preferably about 3 mm.

In some preferred embodiments, the undulating surface profile is made up of a multiple buttons, sheets, rods, cuboids, round, triangular, trapezoid and/or any 3D objects, arranged on one or two sides of the casing.

By "about" or "approximately" in relation to a given numerical value, it is meant to include numerical values within 10% of the specified value. All values given in the present disclosure are to be understood to be complemented by the word "about", unless it is clear to the contrary from the context.

The indefinite article "a" or "an" does not exclude a plurality, thus should be treated broadly.

Unless defined otherwise, technical and scientific terms used herein have the same meaning as commonly understood by one of ordinary skill in the art to which this invention belongs.

A tobacco-containing substrate can be any compound, mixture, particle matter, material and/or solution that contains and/or carries a constituent of tobacco, either artificially included or naturally contained in tobacco, e.g. tobacco, tobacco particles, tobacco flavor and/or nicotine. The liquid substance according to the present invention may comprises the tobacco-containing substrate.

As used herein, the term "smoking device" refers to a device for producing a vapour and/or aerosol that is intended to be heated rather than combusted in order to release volatile compounds that can form a vapour and/or an aerosol.

As used herein, the term "casing" means a case that houses various parts of the smoking device and may be referred to as, for example, the "shell", "housing", or the like.

As used herein, the term "vapour" refers to a material, upon heating, capable of releasing volatile compounds, which can form a vapour and/or an aerosol. The vapour generated from liquid substance described herein may be visible or invisible and may include aerosol (for example, fine particles of substances, which are in a gaseous state, that are ordinarily liquid or solid at room temperature) as well as gases and liquid droplets of condensed vapours.

An electronic cigarette (e-cigarette) or similar devices like electronic pipes or heat-not-burn smoking devices, as referred to in the present invention, are not particularly limited, and may be used to provide a user with an aerosol to inhale. It can, according to certain embodiments, comprise a mouthpiece, a heater, a receiving portion, e.g. a pod, stick, capsule and a casing.

As used herein, the term vibrations described herein refer to vibrations generated by tactile movements over the undulating surface profile of the smoking device initiated by a user, which includes mechanical vibrations as well as sound of waves of vibrations as a result of the mechanical vibrations of the undulating surface profile. The mechanical vibration signals may be picked up by a piezoelectric component while the sound may be picked up by a microphone for instance.

DETAILED DESCRIPTION OF THE INVENTION

The following description of the preferred embodiments is merely exemplary in nature and is in no way intended to limit the scope of the invention, its application or uses.

Figure 1:
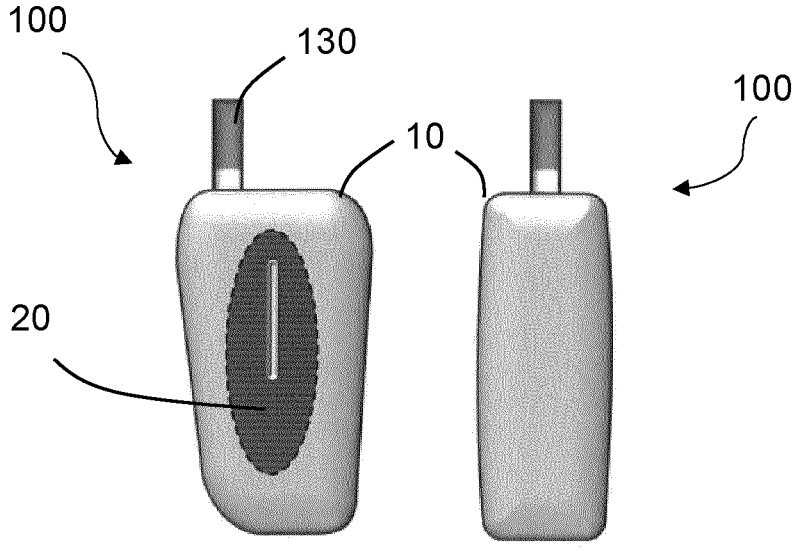
FIG. 1 shows a schematic front and back view of the smoking device according to an embodiment of the invention.

FIG. 1A shows an exemplary of a smoking device 100 according to a first embodiment of the invention. The smoking device 100 may be palm size, having a longitudinal channel where the smoking article 130 can be inserted within to be heated. The smoking device 100 may be an elongated flat device or having a pen-like shape. The casing 10 of the smoking device 100 can be made of a metal comprising metal or plastic material which can withstand high temperature of at least 200° C.

The heating-type device 100 according to the present invention comprises a heater, wherein the heater may be arranged in a central region in a longitudinal direction of the casing. The overall shape of the casing of smoking device may also be a cylindrical shape (rod-like shape).

The smoking article 100 according to the present invention not only is operatable through the conventional methods such as through buttons, it is also operatable by vibrations generated through tactile movement, wherein a series of peaks and grooves are provided on a casing 10 of the smoking device 100. For instance, at least one side of the casing or more sides (e.g., front, and back) can be provided with an undulating surface profile 20 having peaks and grooves (or bumpy patterns), whereby vibration signals can be produced by tactile movements over said undulating surface profile 20 (or bumpy-pattern-arranged section) where the bumpy pattern is formed. The bumpy pattern is made up of a series of peaks and grooves to create uneven surface The bumpy pattern may include a plurality of protrusions aligned on the outer circumferential surface of the casing 10. Further, in the heating-type smoking device 100 according to the present invention, a smooth surface (no-bumpy-pattern-arranged) section where the bumpy pattern is not provided may be formed over a predetermined section, such as from a mouthpiece-opening end of the casing in a longitudinal direction, as well as on the sides and back of the smoking device 100.

It is disclosed herein that a height dimension of each of the protrusions in the undulating surface profiles or bumpy patterns may be larger than a width dimension of the protrusion. This allows a better vibration to be created.

Furthermore, each of the protrusions in the bumpy pattern may have a tapered shape toward a top portion. This will allow a smoother tactile movement over the surface.

Additionally, in the heating-type smoking device 100 according to the present invention, a heat insulating material may be provided on a top portion of each of the protrusions in the bumpy pattern.

As an example, a battery, an electronic control unit, a suction detection sensor, etc. may be housed in the casing 10 of the main body part. Moreover, an LED may be provided on one end of the main body part. The battery may be a rechargeable battery such as, for example, a lithium-ion secondary battery.

The smoking device 100 according to the present invention comprises an electronic system 30, comprising one or more input/output devices, and a signal conditioning or processing device 40 for converting vibration signals generated from the tactile movement over the undulating surface profile 20 of the smoking device 100, into electrical signals which are fed to the electronic system 30 to activate or deactivate corresponding output device based on the vibration signals.

For instance, the electronic system 30 may comprise a computer that controls the entire smoking device 100. Moreover, the electronic system 30 may also comprise, for example, a microprocessor having a circuit board on which a processor, a memory, etc. are mounted. In addition, the smoking device 100 according to the present invention comprises a signal conditioning or processing device 40, wherein the signal conditioning or processing device 40 is a transducer. It is possible that a simple program or software is provided to the smoking device 100 such that the functions of the smoking device 100 (which will be discussed hereinafter) can be carried out through the electrical signals converted from the tactile movements over the undulating surface profile of the casing.

Essentially a transducer is an electronic device which converts energy from one form to another. The transducer may be provided in different forms for instance as an input transducer and/or as an output transducer. An input transducer may be a sensor while an output transducer may be an actuator. On one hand, the input transducer, or sensor, takes a form of physical energy and converts it into a signal which can be read. For example, a microphone takes physical sound waves and turns those into an electrical signal which can be transferred though wires to the amplifier. Another example is a pressure transducer which is also a type of Input transducer. They convert physical force into a number or reading that can be measured and understood. On another hand, the output transducer, or actuator, does the opposite of an input transducer. It takes electrical signals and converts them into another form of energy. For example, a lamp converts electricity to light and a motor converts electricity into motion.

Figure 2:
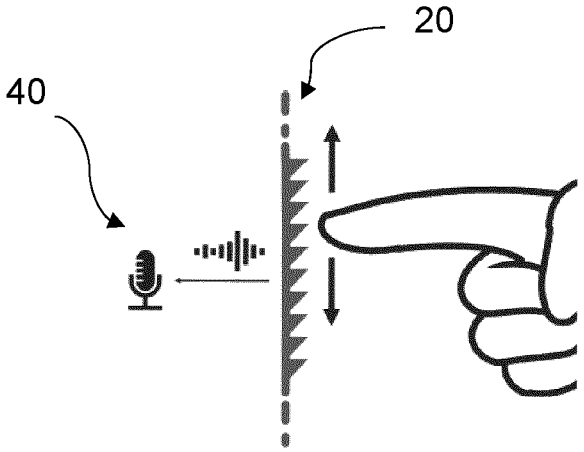
FIG. 2 shows a schematic side view of the smoking device where the device can be operatable through tactile movements.

FIG. 2 shows an example when a user touches and moves his finger on the undulating surface profile 20 of the casing of the smoking device 100, wherein a vibration is generated by the tactile movement which can then be detected by a signal conditioning or processing device 40. In the present case the signal conditioning or processing device 40 is a transducer 40 which is capable of converting vibration signals generated from the tactile movement over the undulating surface profile 20 of the smoking device 100, into electrical signals which are fed to the electronic system 30 to activate or deactivate corresponding output device based on the vibration signals.

To this end, it is disclosed that the vibration signals may also be in the form of sound wave vibrations where a transducer is similarly capable of converting the sound wave vibrations to electrical signals. An example would be microphone.

Figure 3A:
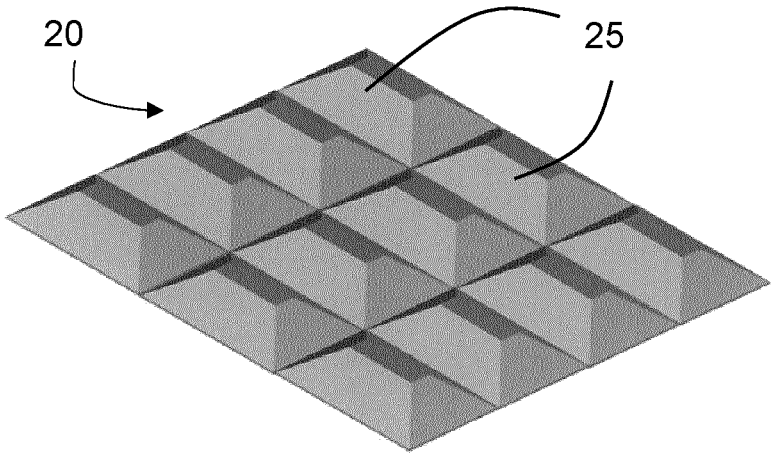
FIG. 3A-C show schematic perspective views of the undulating surface profile according to different embodiments of the present invention.

FIG. 3A shows an example of the undulating surface profile 20 of the smoking device 100 according to one embodiment of the present embodiment, wherein the plurality of protrusions 25 are regularly aligned at constant intervals on the surface of the casing 10, but the present invention is not limited by this. For example, the interval between the plurality of protrusions 25 aligned on the surface of the casing 10 may not be constant. The protrusions 25 illustrated in FIG. 3A may resemble a trapezoid as this increases the surface of the profile. However, the protrusions 25 may also be provided in pyramid form. Such pyramid form protrusion may be suitable to produce higher pitch vibrations so that it can be registered as a distinct signature compared to the trapezoid form protrusion.

Figure 3B:
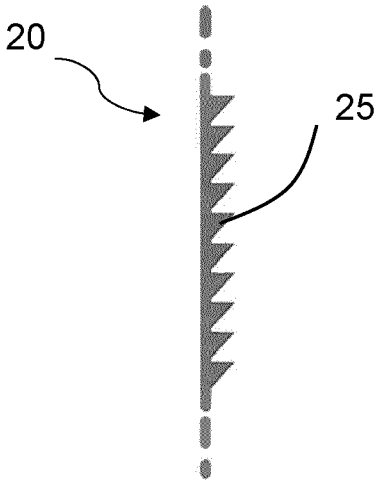

FIG. 3B shows an example of an undulating surface profile having a 1D asymmetry, wherein the elements in relief on the surface of the device are asymmetric along one direction, for instance a saw tooth shape.

Figure 3C:
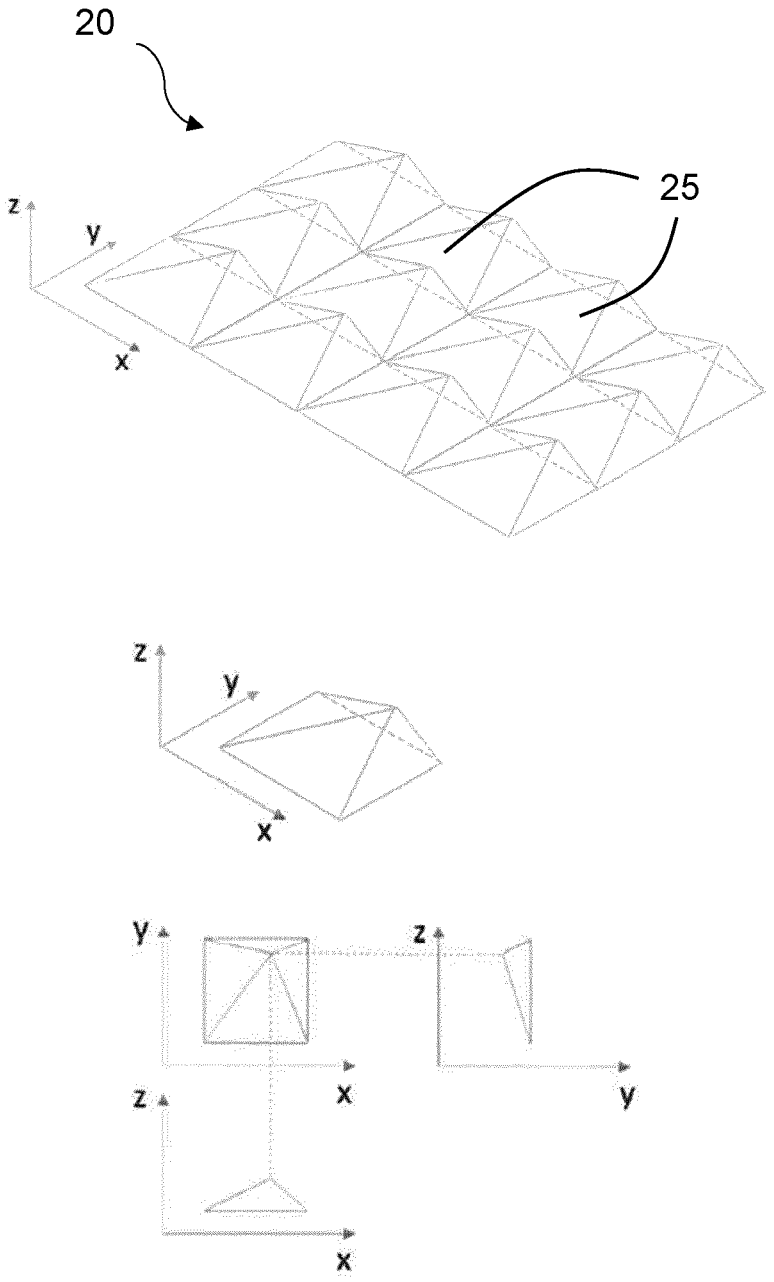

FIG. 3C illustrates another example of an undulating surface profile having a 2D asymmetry, wherein the elements in relief on the surface of the device are asymmetric along two directions. In other words, when a section of the structures in relief along the X and Y directions is being cut, different shapes of geometry surface can be obtained as can be seen in FIG. 3C (middle and bottom). These embodiments have the advantage to allow for different sounds to be generated depending on the direction of the stroking by the user's finger.

According to other embodiments, both the front and back of the smoking device 100 (or any two opposite faces) may be provided with the undulating surface profile 20 having multiple peaks and grooves. Different protrusion forms and arrangements are preferably provided to different face so that different vibration signatures can be created through the tactile movements and be converted to different electrical signals. These different electrical signals can then be used to control different output applications which will be discussed below.

In some embodiments, the interval between the protrusions 25 in the central region of the undulating surface profile 20 is set smaller than the interval between the protrusions 25 in the periphery regions of the undulating surface profile 20. Consequently, it is possible to arrange the protrusions 25 more densely in the central region than in the periphery regions. Accordingly, since the arrangement density of the protrusions 25 is increasingly higher towards the central region, this allow another distinct signal vibration to be created through the tactile movements.

According to the gist of the present invention, multiple distinctive electrical signatures converted from the vibrations or audio signals can be recognisable by the smoking device 100 in order to operate different functions of the smoking device 100 which will be described hereinafter.

Figure 4:
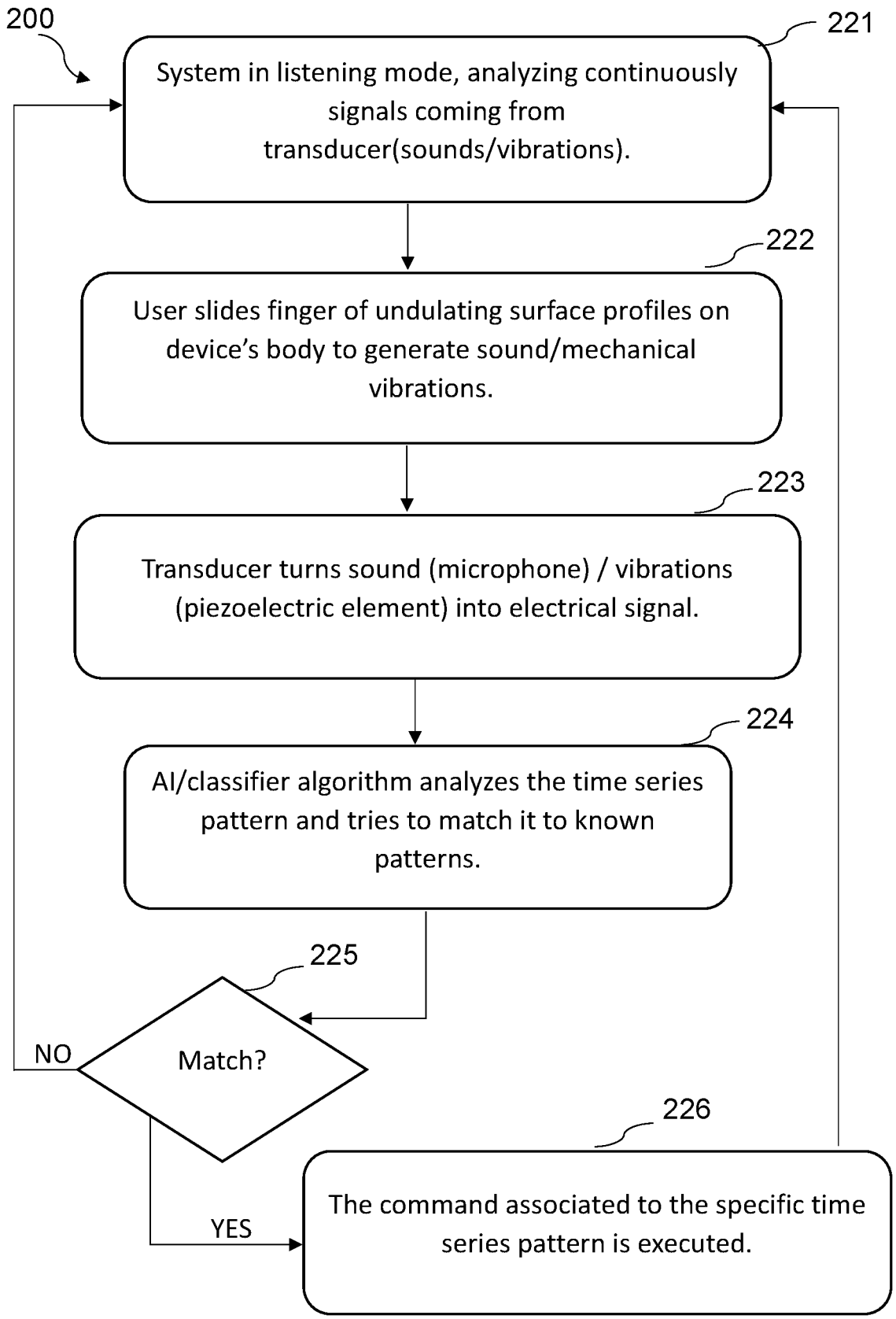
FIG. 4 shows an example of a block diagram of mode of operation of the smoking device according to an embodiment of the present invention.

Referring now to FIG. 4, it illustrates an example of the mode of operation of the smoking device 100 according to the present invention. The method can be performed at least in part by the smoking device 100. Additionally or alternatively, at least some steps can be performed in part by another device operatively connected to the smoking device 100. Of course, the smoking device 100 according to the present invention can be operated on its own. It will be understood that the method as shown in the FIG. 4 is merely example and that a method can be performed with additional steps and/or fewer steps than those illustrated in the FIG. 4.

When the smoking device 100 is turned on, the system is in listening mode 221 to continuously analyse incoming signals. For instance, from transducer (where it converts sound waves or mechanical vibrations into electrical signals). When the user wishes to activate or deactivate or operate certain function of the smoking device 100, step 222 is performed where the user slides, touches, drags, moves one or more fingers on the undulating surface profile 20 having peaks and grooves such that depending on the actions the user wishes to have, by creating sounds or mechanical vibrations correspondingly. The user may learn the respective finger movements from a user's guide, where simple one finger or multiple fingers may be used to generate the mechanical vibrations for instance. As an alternative, it can be also envisaged an operating principle as follows: Device is in sleeping mode until a motion sensor or capacitive sensor understands that the device has been picked up by the user's hand. Once this happens, the microcontroller is switched on and the sound waves and/or mechanical vibrations are then being analysed. In this scenario, it permits the standard microcontrollers to remain in sleep mode while allowing only the circuitry involving in "listening" to operate.

When there is mechanical vibrations generated and vibration signals are detected by the signal conditioning or processing device 40, in the present case is a transducer, the transducer then converts the incoming signals (sounds and/or vibrations) into electrical signal (step 223). The classifier algorithm will then analyse the signal according to the time series pattern and try to match with it with the known patterns (step 224) which is stored within the memory of the smoking device 100. If the entry signature (signal) matches with the known patterns (step 225), the corresponding command will then be executed to carry out the task (step 226). If the entry signature (signal) cannot be recognised (225), the system (of the smoking device 100) will return back to the step 221 where the smoking device 100 is in ready mode i.e. in listening mode, and ready to detect any incoming sounds or vibration signals until a signal is matched with the stored pattern so that the desired function of the user will be carried out.

The smoking device 100 may include a controller with one or more processing units that include or are configured to access a memory having instructions stored thereon. The instructions or computer programs may be configured to perform one or more of the operations or functions described with respect to the smoking device 100. The controller can be implemented as any electronic device capable of processing, receiving, or transmitting data or instructions. For example, the controller may include one or more of: a microprocessor, a microcontroller, a central processing unit (CPU), an application-specific integrated circuit (ASIC), a digital signal processor (DSP), or combinations of such devices. As described herein, the term "processor" is meant to encompass a single processor or processing unit, multiple processors, multiple processing units, or other suitably configured computing element or elements.

The user may be able to create his individual signature entries depending on his preference. For instance, a first type of the electrical signal may be used for turning on or off the smoking device 100, a second type of the electrical signal may be used for checking the power status of the device 100, a third type of the electrical signal may be used for igniting the smoking article, a fourth type of the electrical signal may be used for increasing the heating temperature, a fifth type of the electrical signal may be used for decreasing the heating temperature, a sixth type of the electrical signal may be used for turning on the display and etc.

To this end, it is disclosed that the mechanical vibrations generated through the undulating surface profile 20 can be measured using sensors known in the art such as piezoelectric sensor or micro electromechanical system (MEMS) whereas the sounds can be measured using a microphone. The transducers may be a piezoelectric transducer. This can be accomplished for instance by capturing sound wave energy from the source such as mechanical vibrations generated from tactile movements and converting the signal by using piezoelectric which acts as an energy transducer. Then, an interface circuit may be used to increase the output power to become useful to end application. This can be useful due to the condition of the signal generated in piezoelectric transducer may be low.

A transducer is a device that transforms some form of energy into an electric signal that can be processed by electronic circuits. In the present invention, when the user slides the undulating surface profile 20 of the casing of the device, a distinctive signature is created as this action generates mechanical vibrations that propagate through the device body and in the surrounding air generating a sound. Therefore, to capture the user's input, mechanical vibrations can be measured, for example with a piezoelectric sensor or a MEMS (micro electromechanical system) or measure the sound using a microphone.

The smoking device 100 may include a battery, which can charge and/or power components of the smoking device 100. The battery can also charge and/or power components connected to the smoking device 100, such as a portable electronic device. The battery may be rechargeable.

The smoking device 100 may be equipped with a memory to store electronic data that can be used by the smoking device 100. For example, the memory can store electrical data or content such as, for example, audio files or electrically converted signals or documents and applications, device settings and user preferences, timing and control signals or data for the various modules, data structures or databases, and so on. The memory can be configured as any type of memory. By way of example only, the memory can be implemented as random access memory, read-only memory, Flash memory, removable memory, or other types of storage elements, or combinations of such devices.

The smoking device 100 can further include a display for displaying visual information for a user. The display can provide visual (e.g., simple image or video) output. The display can be or include an opaque, transparent, and/or translucent display. The display may have a transparent or translucent medium through which light representative of images is directed to a user's eyes. The display may utilize digital light projection, OLEDs, LEDs, uLEDs, liquid crystal on silicon, laser scanning light source, or any combination of these technologies.

The display may not be a simple display but more sophisticated display medium, such as an optical waveguide, a hologram medium, an optical combiner, an optical reflector, or any combination thereof. In some implementations, the transparent or translucent display may be configured to become opaque selectively. The smoking device 100 can include an optical subassembly configured to help optically adjust and correctly project the image-based content being displayed by the display for close up viewing. The optical subassembly can include one or more lenses, mirrors, or other optical devices.

As repeatedly disclosed, the smoking device 100 can include one or more microphones as described herein. The microphones can be operably connected to the processor for detection of sound levels and communication of detections for further processing, as described further herein.

Moreover, the smoking device 100 may include a speaker. The speakers may be operably connected to the processor for control of speaker output, including sound levels, as described further herein.

The invention claimed is:

1. A smoking device operatable by vibration generated through tactile movement, comprising a casing, wherein at least one side of the casing is provided with an undulating surface profile, whereby vibration signals are produced by tactile movement over said undulating surface profile; and an electronic system configured to activate or deactivate the smoking device based on the vibration signals.

2. The smoking device according to claim 1, wherein the electronic system comprises one or more input/output devices, and a signal conditioning or processing device for converting vibration signals generated from the tactile movement over the undulating surface profile of the smoking device, into electrical signals which are fed to the electronic system to activate or deactivate a corresponding output device of the one or more input/output devices based on the vibration signals.

3. The smoking device according to claim 2, wherein the signal conditioning or processing device is a transducer.

4. The smoking device according to claim 2, wherein an input device of the one or more input/output devices comprises one or more sensors, wherein each of the one or more sensors comprises a piezoelectric sensor, an accelerator, MEMS, or a microphone.

5. The smoking device according to claim 1, wherein the vibration signals are generated from mechanical vibration or sound waves.

6. The smoking device according to claim 2, wherein an input device of the one or more input/output devices comprises a transducer.

7. The smoking device according to claim 1, wherein the undulating surface profile comprises peaks and grooves, forming at least two, three, four, five, six or more different undulating surface profiles to generate different vibration signals.

8. The smoking device according to claim 2, wherein the output device comprises one or more LED lights, a piezo electric igniter, an on/off button, a temperature control, loud speakers and/or a power status.

9. The smoking device according to claim 7, wherein a height difference between the peaks and the grooves of the undulating surface profile is between 0.5 mm and 10 mm.

10. The smoking device according to claim 7, wherein a distance between one of the peaks to another one of the peaks of the undulating surface profile is between 0.5 mm and 8 mm.

11. The smoking device according to claim 7, wherein a distance between one of the grooves to another one of the grooves of the undulating surface profile is between 0.5 mm and 6 mm.

12. The smoking device according to claim 1, wherein the undulating surface profile is made up of multiple buttons, sheets, rods, cuboids, round, triangular, trapezoid and/or any 3D objects, arranged on one or two of the at least one side of the casing.

13. The smoking device according to claim 7, wherein a height difference between the peaks and the grooves of the undulating surface profile is 4 mm.

14. The smoking device according to claim 7, wherein a distance between one of the peaks to another one of the peaks of the undulating surface profile is 3 mm.

15. The smoking device according to claim 7, wherein a distance between one of the grooves to another one of the grooves of the undulating surface profile is 3 mm.

16. A method of operating the smoking device according to claim 1, comprising the steps of:

generating a vibration through a tactile movement on the undulating surface profile of the casing of the smoking device;

converting vibration signals to electrical signals through a signal conditioning or processing device; and activating or deactivating an output device and/or a function of the smoking device.

* * * * *